United States Patent [19]

Krob

[11] 4,111,453

[45] Sep. 5, 1978

[54] RELEASE BINDING

[75] Inventor: Erwin Krob, Vienna, Austria

[73] Assignee: TMC Corporation, Baar, Switzerland

[21] Appl. No.: 750,410

[22] Filed: Dec. 14, 1976

[30] Foreign Application Priority Data

Dec. 19, 1975 [AT] Austria ..... 9720/75

[51] Int. Cl. ..... A63c 9/08

[52] U.S. Cl. ..... 280/626

[58] Field of Search ..... 280/626, 631, 632, 633

[56] References Cited

U.S. PATENT DOCUMENTS

| | | | |
|---|---|---|---|
| Re. 26,670 | 9/1969 | Smolka | 280/626 |
| 3,527,468 | 9/1970 | Berchtold | 280/632 |
| 3,625,532 | 12/1971 | Pauls | 280/626 |
| 3,675,937 | 7/1972 | Laszlo | 280/626 |
| 3,727,935 | 4/1973 | Unger | 280/626 |
| 3,933,363 | 1/1976 | Schweizer | 280/626 |
| 3,989,273 | 11/1976 | Schmidt | 280/631 |

*Primary Examiner*—Robert R. Song

*Attorney, Agent, or Firm*—Blanchard, Flynn, Thiel, Boutell & Tanis

[57] ABSTRACT

A heel holding release binding mountable on a ski and having a pivotal housing which has a movable blocking part locked by a locking element which can be moved against the force of a spring. In a position of use, the locking element engages a stop arranged on an operating lever which is pivotally supported on the housing. The blocking part is formed by a bolt which extends parallel to the upper side of the ski and terminates at opposite ends thereof in slots provided in the sidewalls of the housing. The base plate has a recess therein into which is received, in the position of use of the heel holder, an extension, shoulder or the like on the lever.

9 Claims, 7 Drawing Figures

RELEASE BINDING

FIELD OF THE INVENTION

The invention relates to a release binding preferably a heel holder with a swivelable or pivotally supported housing which has a movable blocking part locked by a locking element which can be moved against the force of a spring and engages a stop in a position of use, wherein the stop is arranged on an operating lever which is pivotally supported in the housing and wherein the blocking part is formed by a pin, bolt or the like which is parallel to the upper side of the ski, the ends of which pin, bolt or the like are supported movably in slots in the sidewalls of the housing.

BACKGROUND OF THE INVENTION

A release binding of this type is for example described in Austrian Pat. No. 296,839. In this known construction the blocking part is loaded one-sidedly by the locking element, wherein slots are provided for the movable support of the blocking part and lie substantially horizontally in the closed position of the binding. Therefore, the entire system must be operated during an arbitrary release.

A construction in which for the blocking mechanism and for the longitudinal adjustment a uniform spring arrangement exists is described for example in German OS No. 2,255,976. An additional spring is provided for the lever which effects an arbitrary release. The lever has a recess therein which cooperates with a locking pin arranged transversely with respect to the longitudinal direction of the ski and which is secured on a binding part which is independent from the lever. However, in this construction exists the disadvantage that the heel holder after release of the ski boot is returned again into the closed position (holding position). This has the disadvantage that the user must bend down prior to reentering and must open the heel holder. A further disadvantage is that, if the heel holder did not open up at all, because the release took place in the area of the front jaw, an arbitrary release by hand must be carried out for stepping in. This can be particularly complicated in the case of deep snow.

The purpose of the invention is to overcome this and to provide a heel holder which adjusts in every position, where there is no ski boot in the binding, automatically into the stepping-in opening.

This set purpose is attained by the base plate having at least one recess therein into which engages, in the locking position of the heel holder, an extension, shoulder or the like of a lever. This measure assures that the thrust spring which loads the housing will permit the extension, shoulder or the like of the lever only to engage the recess of the base plate when the spur and thus the down-holding part is placed into the holding position by a boot. If the heel holder releases under the action of a force which acts onto the boot, the housing is moved forwardly and thus the locking action between the pin and the recess of the lever is cancelled. During an arbitrary operation of the lever, the locking action is also cancelled so that the heel holder is again in the stepping-in position. If a release takes place in the area of the front jaw, then the holding position is also cancelled and the lever is released by the pin through the action of the thrust spring.

According to a particularly advantageous embodiment of the invention, the lever is loaded in a conventional manner by a spring wherein the force of the spring is measured so that it always holds open the heel holder in the release position. This measure is needed in order to act securely against the frictional forces existing in the heel holder and the summed weight of the movable parts.

According to a still further characteristic of the invention, a lock can be provided by means of which the heel holder can be held in engagement in the closed position against the force of the spring. Since the purpose of the invention is to keep the heel holder at all times ready for stepping in, care must be taken so that the heel holder can be transported also in the closed position.

BRIEF DESCRIPTION OF THE DRAWINGS

Further advantages and details of the invention will be discussed more in detail with reference being made to the drawings which illustrate one exemplary embodiment.

In the drawings:

FIGS. 1 and 2 each illustrate a view of the inventive heel holder wherein FIG. 1 illustrates the released or stepping-in position and FIG. 2 illustrates the holding position;

DETAILED DESCRIPTION

Figure 1:
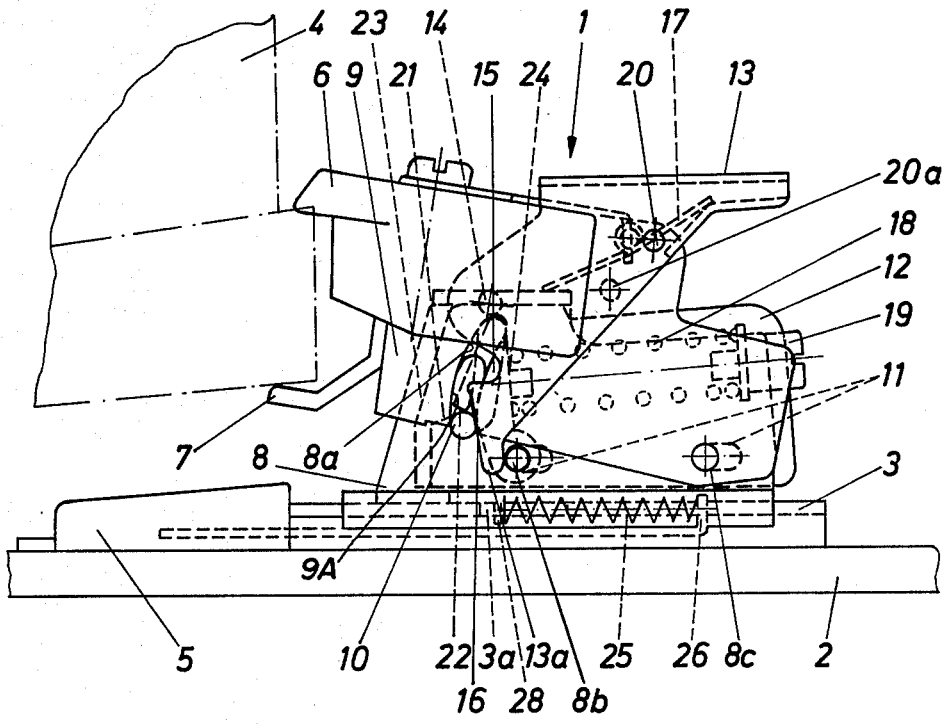

An inventive heel holder which as a whole is identified by reference numeral 1 is secured in a conventional manner on a ski 2 by means of a generally U-shaped base plate 3 fixed to the ski. The base plate 3 has adjacent its front end a stepping plate 5 on which rests the sole of a ski boot 4 which is indicated in broken lines (according to FIG. 2). The heel holder 1 has a holding or hold-down part 6 vertically spaced from a spur 7, the structure of which and operation is known to the man skilled in the art so that a further description of these parts is believed unnecessary.

Figure 3:
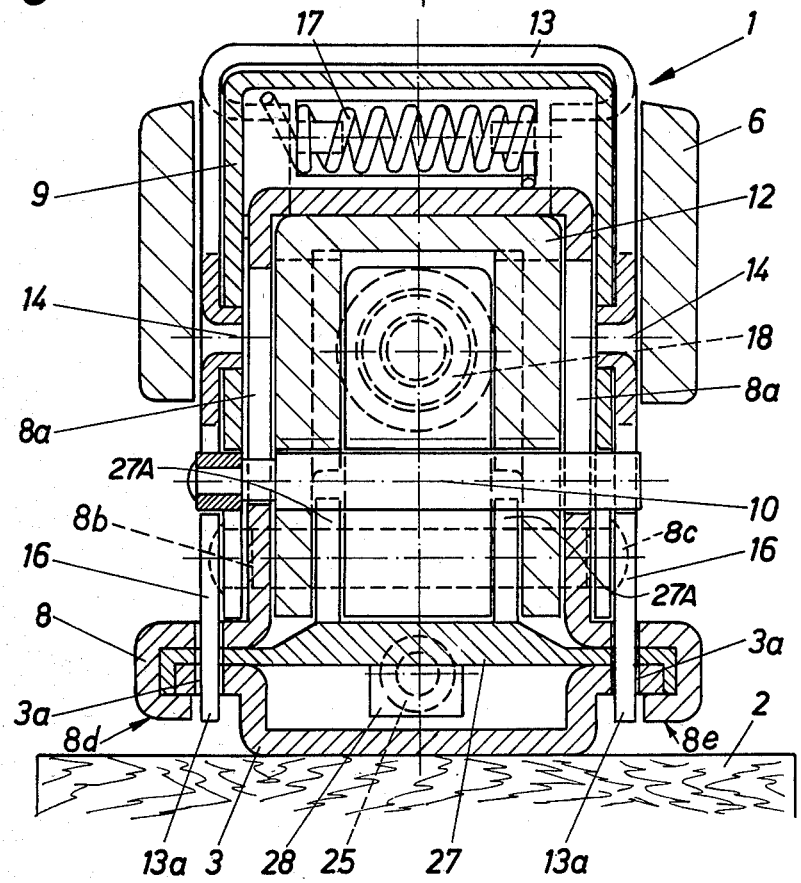
FIG. 3 illustrates a cross-sectional view taken along the line III—III of FIG. 2 in an enlarged scale.

The heel holder 1 also has a housing 9 pivotally mounted on a bearing block 8. The bearing block 8 is slidable along the base plate 3 due to the vertically overlapped flange connection therebetween as at **8*d* and 8*e* (FIG. 3). A moderately arced slot 8*a* is provided in the bearing block 8 in which there is guided a free floating pin, bolt 10 or the like which extends transversely to the longitudinal axis of the ski. The pin, bolt 10 or the like is controlled from above by the housing 9. The housing 9 is pivotally supported on the bearing block 8 as stated above by means of a pivot pin or bolt 8*c*. The bearing block 8 also has a guide pin 8*b*, the length of which is less than the length of the bolt 8*c* (see FIG. 3). A slide 12 which has a plurality of horizontally extending longitudinal slots 11 therein receiving the guide pin 8*b* and the bolt 8*c* therein and being movable relative thereto. Thus, the pivot bolt 8*c* also functions as a guide pin for the slots 11 of the slide 12**.

Figure 5:
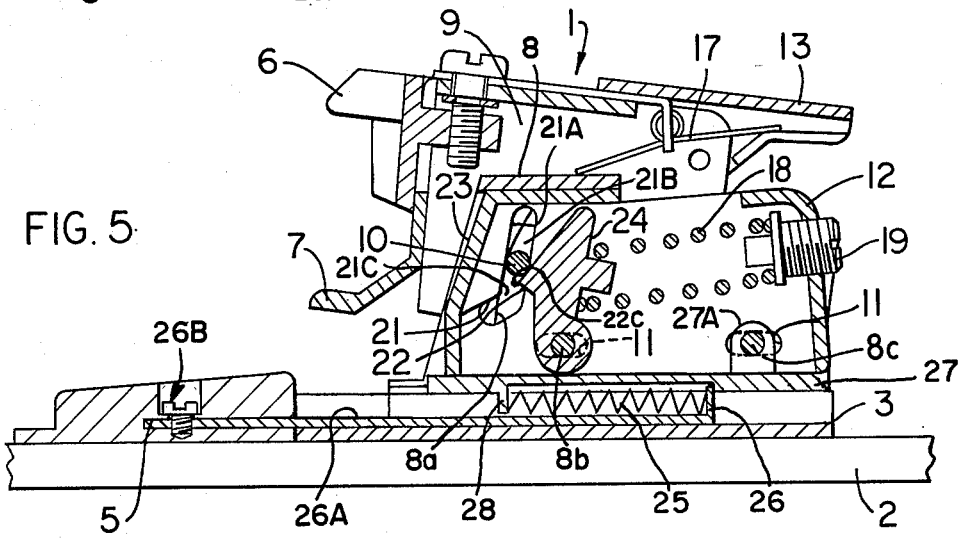
FIG. 5 is a sectional view similar to FIG. 4 but with the components in a position following an automatic release.
Figure 6:
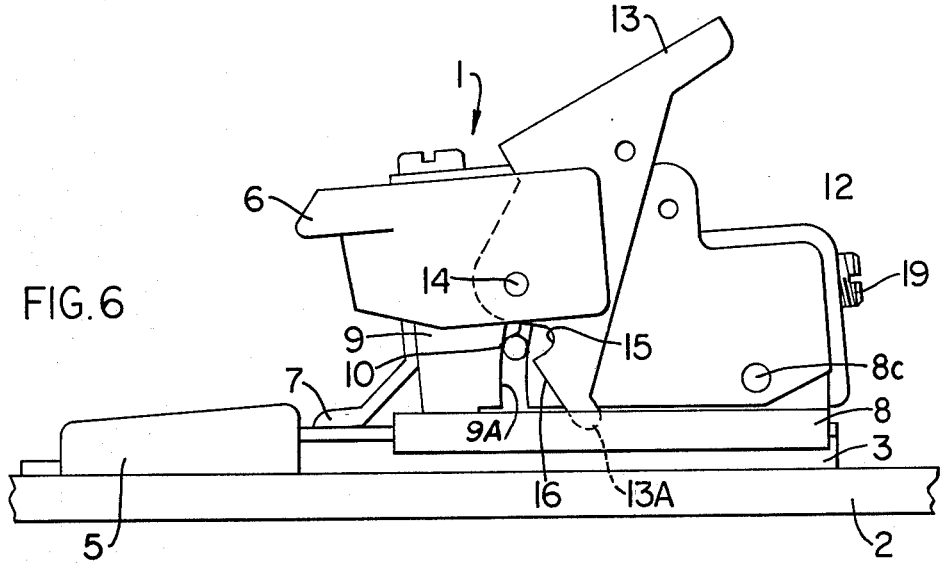
FIG. 6 is a side view similar to FIG. 2 but with the components in a position intermediate the manual release of the heel holder.
Figure 7:
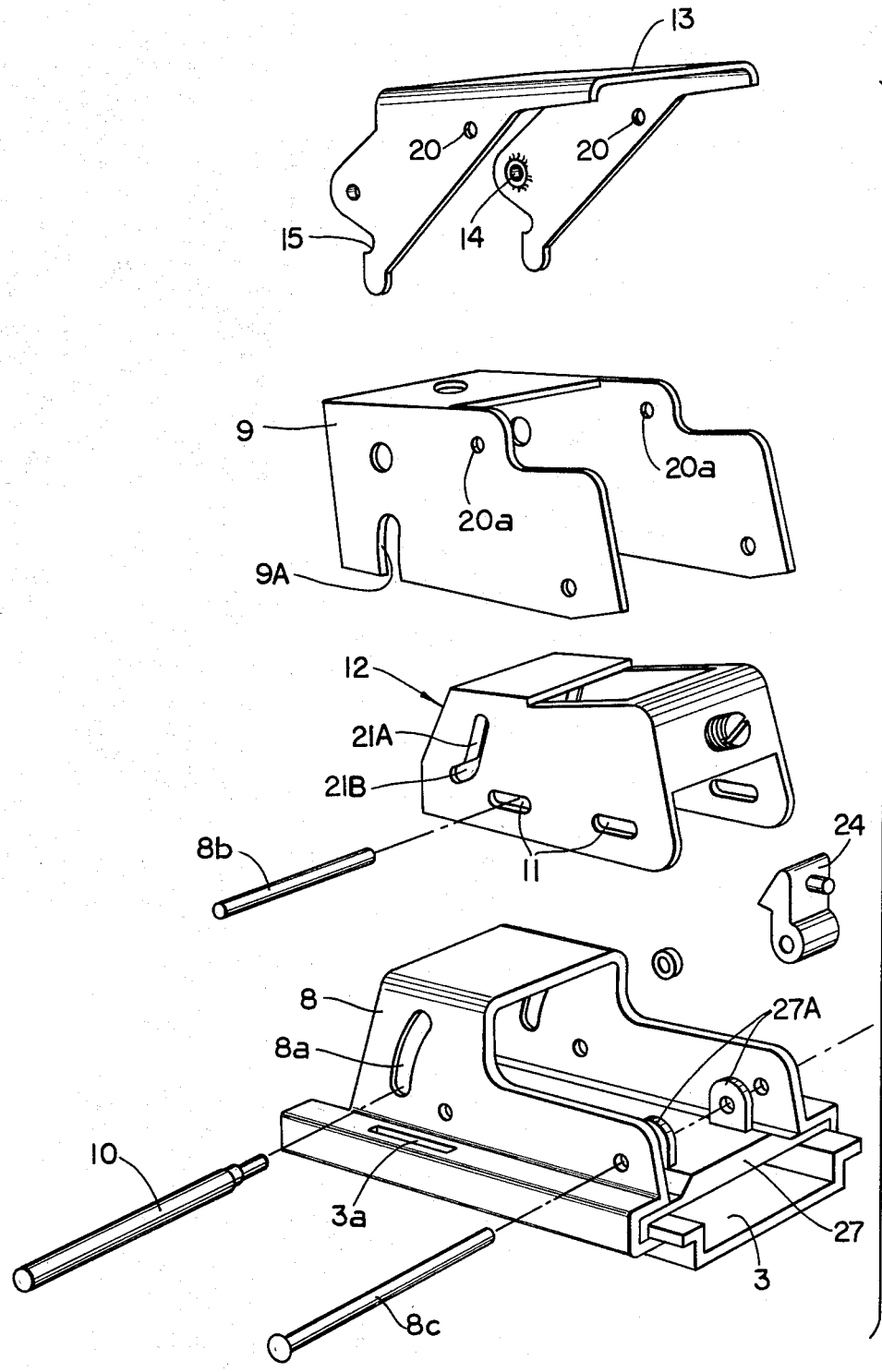
FIG. 7 is an exploded isometric view of the ski binding components.

A lever 13 is pivotally secured on a pivot axis 14 to the housing 9. The lever 13 externally overlaps the outside of the housing 9 and the upper part of the bearing block 8. The lever 13 has in its area which is associated with the pin, bolt 10 or the like a recess or notch 15 (see particularly FIG. 1) which engages and supports the bolt 10. Thus, the notch 15 carries the pin 10 vertically during normal release of the binding to the position illustrated in FIG. 5. The lower edge of the recess 15 terminates in a guide curve 16. A torsion spring 17 is arranged in the upper part of the housing 9 and has a leg at one end supported against the upper part of the bearing block 8 and another leg at the other end against the inside of the lever 13. The torsion spring 17 urges the holding part 6 continuously toward the opened condition through its structural relation with the housing 9. The upper limit position of the pin, bolt 10 or the like is controlled by the position of the housing 9 relative to the bearing block 8.

A coil spring 18 is also provided in the slide 12 and functions through means of a setscrew 19 in a conventional manner to permit an adjustment of the initial release force for the heel holder. The pin, bolt 10 or the like is held down by two additional cam parts 21 and 22. The cam part 21 is defined by an edge 21A of an angled slot 21B in the sidewalls of the slide 12. The spring 18 directly engages at one end the rear area 24 of the one cam part 22 and at the other end through the setscrew 19 and the sidewalls of the slide member 12 to the cam part 21. Through this it is achieved that for determining the initial release force by which the holding part 6 holds the ski boot 4 in the position of use, a smaller spring force is sufficient because the pin or bolt 10 is loaded or held in the boot holding position twice by one and the same spring. The cam part 22 is pivotally supported on the guide pin **8*b***.

To secure the lever 13 in the holding position, even when there is no boot in the binding as for transport, a hole 20 is used in the present exemplary embodiment which, in the closed position of the heel holder 1, is coincident with a further bore **20*a* which is provided in the housing 9 (and/or in the bearing block 8**) and can be secured in this position by means of a not illustrated pin.

Figure 2:
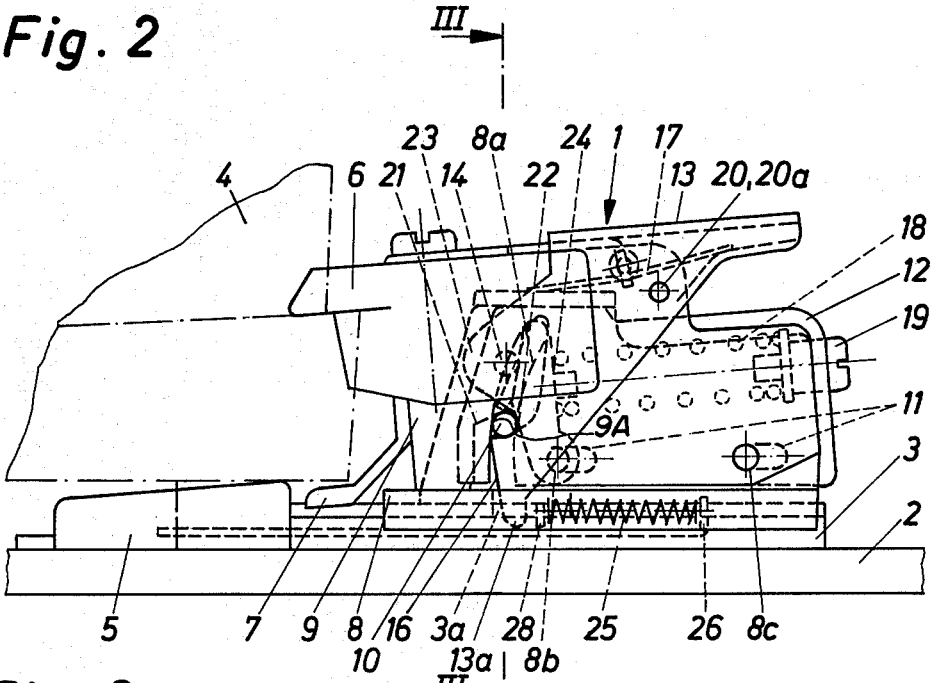

The guide curve 16 of the lever 13 has provided thereon an extension or shoulder **13*a*. The shoulder 13*a* is received in a recess 3*a* in the base plate 3 and in the bearing block 8. This position is illustrated in FIG. 2. In the released or stepping-in position illustrated in FIG. 1, the shoulder 13*a* is outside of the recess 3*a*. A comparison of FIGS. 1 and 2 illustrates the different position and also the loose or clamped position of a thrust spring 25. One end of the thrust spring 25 is supported on a stop 26. The stop 26 is secured through an extension member 26A to the stepping plate 5 by means of a fastener 26B, such as a screw. An extension 28 of a cover 27 is engaged and loaded by the other end of the thrust spring 25 and thus the longitudinal movement of the heel holder 1 is effected thereby. The cover 27 has tabs 27A thereon each with a hole therethrough through which is received the pin 8*c***.

OPERATION

Figure 4:
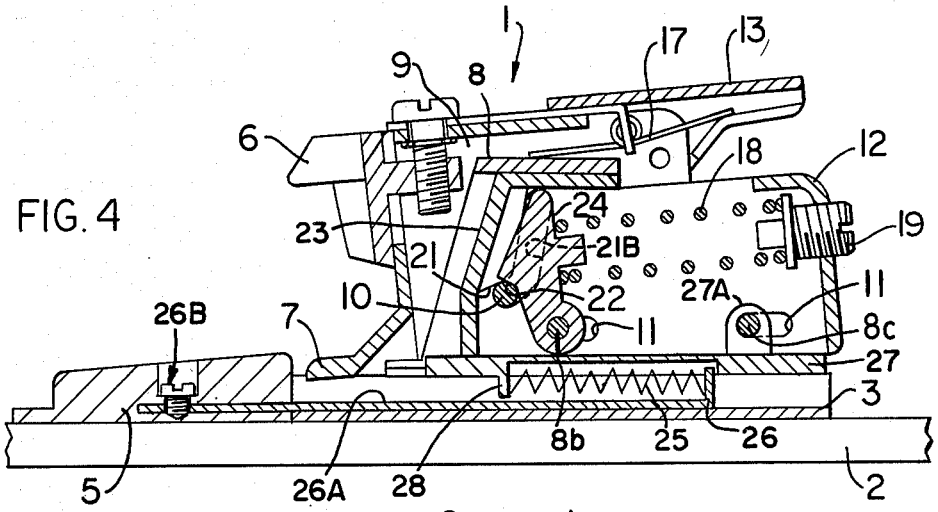
FIG. 4 is a central longitudinal sectional view of the heel holder in the ski boot holding position.

The inventive heel holder 1 is operated as follows. During an automatic release, an outer force acts onto the ski boot 4 through the heel thereof onto the holding part 6. A force is thus applied onto the housing 9 of the heel holder 1, which force effects a swiveling or pivoting of the housing 9 about the bolt **8*c*. An upward swiveling of the housing 9 will cause the pin, bolt 10 or the like to be moved upwardly in the longitudinal slot 8*a* of the bearing block 8 by the notch 15 of the lever 13 mounted on the housing 9. The pin, bolt 10 or the like engages the two cam parts 21 and 22 in such a manner that a spreading apart of these two parts occurs. Thus, the cam part 21 is moved forwardly against the force of the spring 18 and causes the slide 12 to also carry out a forward longitudinal movement relative to the bearing block 8 (compare FIGS. 4 and 5). The cam part 22 is pivoted backwardly about the axis of the guide pin 8*b* which now functions as a pivot bolt to additionally compress the loaded spring 18. As stated above, the movement of the pin, bolt 10 or the like is caused by the lever 13 which is pivotally secured to the housing 9 at the pivot axis 14. The recess 15 on the lever 13 is loaded by the torsion spring 17 carrying along with its recess 15 the bolt 10. As soon as the bolt 10 has exceeded the threshold points 21*c* and 22*c* (FIG. 5) of the cam parts 21 and 22, further opening is effected by the torsion spring 17 until the ski boot 4 is released by the holding part 6**. Such a release is known to the man skilled in the art and, therefore, does not need any further discussion.

An arbitrary release takes place in the following manner, wherein the final position of the components in this release operation is shown in FIG. 1. Starting from the condition of FIG. 2, which illustrates the closed position, the not illustrated pin being removed from the aligned holes 20 and **20*a* and a force is applied to the lever 13 and causes same to be pivoted about the pivot axis 14 so that the recess 15 is moved downwardly and rearwardly away from the bolt 10 to become disengaged therefrom. Now the torsion spring 17 becomes effective since it is supported on the bearing block 8 and pivots with the lever 13 on the housing 9 about the axis of the bolt 8*c*. In this case, the free floating bolt 10** remains therefore in the lower position.

During an automatic release by the front jaw, the not illustrated pin being removed from the aligned holes 20 and **20*a* and the ski boot 4 moves away from the heel holder and causes the thrust spring 25 to urge and move the entire heel holder 1 forwardly so that the extension, shoulder 13*a* or the like of the lever 13 engages the edge of the recess 3*a* of the base plate 3 and causes a swiveling of the heel holder 1 about the pivot axis 14. First the extension, shoulder 13*a* or the like slides thereby upwardly on the mentioned edge and the pin, bolt 10 or the like becomes disengaged from the recess 15 at the same time. The guide curve 16 slides then due to the action of the torsion spring 17 along the pin, bolt 10 or the like, until the position of the heel holder 1 shown in FIG. 1 is reached, whereby in this case the ski boot 4** must be imagined as nonexistent.

According to all three discussed opening operations, the heel holder remains always ready for stepping in because the part of the torsion spring 17, which part is between the housing 9 and the bearing block 8, serves as an opening spring. To summarize the heel holder 1 moves in all three cases automatically into the ready position to receive the ski boot. From this follows that the heel holder 1 must be closed for transporting by a separate lock in the case wherein a transport with an opened binding is not desired. The lock is defined in the present example by the bores 20, **20*a*, through which, and after alignment thereof, a not illustrated pin can be guided. For this purpose the holding part 6 is first moved into the position shown in FIG. 2 and the lever 13 is still open. A pressure is now applied onto the operating end of the lever 13 and the closing position according to FIG. 2 is achieved, whereby here the ski boot 4 is again to be imagined as nonexistent. The two bores 20, 20***a* are thereby in alignment (compare the associated parts in FIGS. 1 and 2) and the locking pin can be inserted therein.

The invention is not to be limited to the described exemplary embodiment. Various modifications are possible without departing from the scope of the invention. For example, it would be possible to also provide the automatic stepping-in feature at the jaw wherein the aforedescribed release operation with opened jaw and closed heel holder is to be interpreted in reversed manner. Furthermore, the use of the automatic stepping-in feature is also conceivable in connection with a differently designed heel, for example with a heel holder according to Austrian Pat. No. 327,068 which corresponds to U.S. Pat. No. 3,933,363. In this case, the control curve which is there provided is brought into connection with the lever, wherein an extension similar to the described one is associated with the lever and, for the purpose of overcoming the occurring forces, the lever arm is extended accordingly.

The pin which is provided for closing the heel holder for the transport can also be used as a part of a holding bar or closing lock to prevent theft.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A releasable heel holder for holding a ski boot on a ski, comprising:

a base plate secured to said ski and having track means thereon extending in a direction parallel to the longitudinal axis of said ski;

a bearing block mounted on said base plate and including means cooperable with said track means for guiding said bearing block longitudinally thereof;

first resilient means for biasing said bearing block toward the tip of said ski;

slide means mounted on said bearing block and being reciprocal with respect thereto;

housing means having ski boot engaging means thereon pivotally mounted on said bearing block for movement about a pivot axis fixed to said bearing block between a position of use and a boot release position and in overlapping relationship to said bearing block and said slide means;

pin guide means in said slide means;

pin means received in said pin guide means and extending transversely of said ski and laterally beyond said housing means;

a lever movably secured to said housing means for movement between a release position and a position of use, said lever having a notch for receiving said pin means therein, a pivoting of said housing means effecting a movement of said lever therewith and a movement of said pin means in and relative to said pin guide means; and releasable locking means mounted on said slide means and movable therewith, said locking means including means defining a threshold point and second resilient means yieldingly resisting movement of said pin means in said pin guide means past said threshold point.

2. A releasable heel holder according to claim 1, wherein said lever has an extension thereon; and wherein said bearing block and said base plate each have means defining a recess for receiving said extension therein, said recesses and said extension being so proportioned to facilitate a pivotal movement of said extension with said housing means into and out of said recesses when said ski boot is positioned on said ski and engaging said heel holder.

3. A releasable heel holder according to claim 2, including third resilient means urging said lever into said position of use, said third resilient means, when said lever is manually moved to said release position, effecting a pivoting of said housing means to said boot release position and a resilient holding of said housing means in said boot release position.

4. A releasable heel holder according to claim 2, wherein an automatic release of said ski boot from said ski will cause said first resilient means to shift said bearing block toward said tip of said ski relative to said base plate and said extension to engage the forward edge of said recess in said base plate and pivot rearward to position said notch out of alignment with said pin means to facilitate a free pivoting of said housing means.

5. A releasable heel holder according to claim 1, including second releasable locking means for immovably locking said lever to said housing means.

6. A releasable heel holder according to claim 5, wherein said second releasable locking means includes a means defining a hole in each of said lever and said housing means and second pin means, said second pin means being received in said holes when in alignment.

7. A releasable heel holder according to claim 6, wherein said holes in said housing means and said lever are provided in both lateral sides thereof.

8. A releasable heel holder according to claim 1, wherein said lever includes means for pivotally securing said lever to said housing means.

9. A releasable heel holder for releasably holding a ski boot to a ski, comprising:

a base secured to said ski;

rail means on said base extending parallel to the longitudinal axis of said ski;

bearing block means on said base and operatively engaged with said rail means to facilitate a movement of said bearing block means relative to said base;

first resilient means for urging said bearing block means toward the tip of said ski relative to said base;

first and second pivot means fixedly mounted on said bearing block means and movable therewith;

means defining an arcuate slot on said bearing block means spaced from said pivot means, the center point of the radius for said arcuate slot means being coincident with said first pivot means;

locking pin means extending transversely of said longitudinal axis of said ski received in said arcuate slot means and being feely movable therein;

slide means mounted on said bearing block means and guided for movement relative to said bearing block means by said first and second pivot means, said slide means having means defining an angled slot therein for receiving said locking pin means therein and guiding said locking pin means along the length thereof, the forward edge of said slot having means defining a first threshold point thereon;

cam means pivotally secured to said second pivot means and being movable toward and away from said forward edge;

second resilient means engaging and extending between said slide means and said cam means to bias said cam means in a position toward said forward edge, said locking pin means being positioned below said threshold point; and sole holding means pivotally secured to said first pivot means and movable between a sole holding position and a sole release position and including means engaging and carrying along therewith said locking pin means, said second resilient means yieldingly resisting movement of said sole holding means and said locking pin means past said threshold point.

* * * * *